US010173386B2

(12) United States Patent
Wnek

(10) Patent No.: US 10,173,386 B2
(45) **Date of Patent: *Jan. 8, 2019**

(54) BLANK AND FORMING TOOL FOR FORMING A CONTAINER

(71) Applicant: Graphic Packaging International, Inc., Atlanta, GA (US)

(72) Inventor: Patrick H. Wnek, Sherwood, WI (US)

(73) Assignee: Graphic Packaging International, LLC, Atlanta, GA (US)

( * ) Notice: Subject to any disclaimer, the term of this patent is extended or adjusted under 35 U.S.C. 154(b) by 956 days.

This patent is subject to a terminal disclaimer.

(21) Appl. No.: 13/893,492

(22) Filed: May 14, 2013

(65) Prior Publication Data

US 2013/0244849 A1 Sep. 19, 2013

Related U.S. Application Data

(62) Division of application No. 12/881,632, filed on Sep. 14, 2010, now Pat. No. 8,464,871.

(60) Provisional application No. 61/242,145, filed on Sep. 14, 2009.

(51) Int. Cl.

| | |
|---|---|
| ***B31B 1/62*** | (2006.01) |
| ***B31B 3/26*** | (2006.01) |
| ***B65D 1/34*** | (2006.01) |
| ***B31B 50/26*** | (2017.01) |
| *B31B 100/00* | (2017.01) |
| *B31B 50/59* | (2017.01) |

(52) U.S. Cl.

CPC ..... *B31B 3/26* (2013.01); *B31B 50/26* (2017.08); *B65D 1/34* (2013.01); *B31B 50/592* (2018.05); *B31B 2100/00* (2017.08)

(58) Field of Classification Search

CPC ..... B31B 3/26; B31B 43/00; B31B 2201/223; B65D 1/34

USPC ..... 493/143

See application file for complete search history.

(56) References Cited

U.S. PATENT DOCUMENTS

| | | | | |
|---|---|---|---|---|
| 1,022,882 A | | 4/1912 | Schwenn | |
| 1,848,066 A | * | 3/1932 | Shepard | A47G 19/02 220/575 |
| 2,522,397 A | | 9/1950 | Palmer | |
| 2,595,046 A | * | 4/1952 | Amberg | B31B 43/00 229/5.8 |

(Continued)

FOREIGN PATENT DOCUMENTS

| | | |
|---|---|---|
| DE | 509 065 | 4/1969 |
| DE | 80 11 020 | 9/1980 |

(Continued)

OTHER PUBLICATIONS

Supplementary European Search Report for EP 03776279 dated Jan. 28, 2009.

(Continued)

*Primary Examiner* — Sameh Tawfik

(74) *Attorney, Agent, or Firm* — Womble Bond Dickinson (US) LLP

(57) ABSTRACT

A blank for being formed into a container. The blank has a marginal area that includes a plurality of score lines for facilitating forming of the blank into the container. The score lines are positioned to facilitate formation of the container. A forming tool has features to facilitate forming the blank into the container.

16 Claims, 6 Drawing Sheets

(56) References Cited

U.S. PATENT DOCUMENTS 2,634,880 A 4/1953 Gravatt
2,997,927 A 8/1961 Carson
3,033,434 A 5/1962 Carson
3,099,377 A 7/1963 Metzler et al.
3,104,012 A * 9/1963 Beamish ..... B31B 1/46 206/438
3,135,455 A * 6/1964 Santangelo ..... B29C 45/14475 206/438
3,195,770 A 7/1965 Robertson
3,220,631 A 11/1965 Reifers
3,229,886 A 1/1966 Grogel
3,286,876 A 11/1966 Ring
3,459,356 A * 8/1969 Sparks ..... B65D 5/5028 229/120.07
3,464,618 A * 9/1969 Martelli ..... B65D 85/34 206/521.1
3,530,917 A 9/1970 Donavan
3,565,321 A * 2/1971 Weiss ..... B65D 1/36 220/23.8
3,669,305 A 6/1972 Kinney et al.
3,680,733 A 8/1972 Winslow
3,684,633 A 8/1972 Haase
3,834,606 A * 9/1974 Andersson ..... B65D 1/34 206/204
3,850,340 A 11/1974 Siemonsen et al.
3,968,921 A 7/1976 Jewell
4,026,458 A 5/1977 Morris et al.
4,051,707 A 10/1977 Valek et al.
4,096,947 A 6/1978 Morse
4,139,115 A 2/1979 Robinson
4,183,435 A 1/1980 Thompson et al.
4,202,464 A 5/1980 Mohs et al.
4,284,023 A 8/1981 Murayama
4,554,127 A * 11/1985 Hain ..... B31B 43/00 264/324
4,606,496 A 8/1986 Marx et al.
4,609,140 A 9/1986 Van Handel et al.
4,704,510 A 11/1987 Matsui
4,721,499 A * 1/1988 Marx ..... B65D 1/34 264/324
4,721,500 A * 1/1988 Van Handel ..... A47G 19/03 264/324
4,775,771 A 10/1988 Pawlowski et al.
4,832,676 A * 5/1989 Johns ..... B31B 43/00 264/320
4,865,921 A 9/1989 Hollenberg et al.
4,890,439 A 1/1990 Smart
4,935,089 A 6/1990 Schirmer
4,936,935 A 6/1990 Beckett
4,963,424 A 10/1990 Beckett
4,967,908 A 11/1990 Kessler
5,039,364 A 8/1991 Beckett et al.
5,083,699 A * 1/1992 Bulcher ..... B65D 1/34 229/125.17
5,117,078 A 5/1992 Beckett
5,190,209 A 3/1993 Gordon et al.
5,213,902 A 5/1993 Beckett
5,221,419 A 6/1993 Beckett
5,260,537 A 11/1993 Beckett
5,266,386 A 11/1993 Beckett
5,269,717 A 12/1993 Tardif
RE34,683 E 8/1994 Maynard et al.
5,340,436 A 8/1994 Beckett
5,354,973 A 10/1994 Beckett
5,410,135 A 4/1995 Pollart et al.
5,424,517 A 6/1995 Habeger, Jr. et al.
5,519,195 A 5/1996 Keefer et al.
5,588,587 A * 12/1996 Stier ..... B65D 5/5455 206/557
5,617,972 A 4/1997 Morano et al.
5,628,921 A 5/1997 Beckett
5,672,407 A 9/1997 Beckett
5,758,773 A 6/1998 Clements
5,759,422 A 6/1998 Schmelzer et al.
5,782,376 A 7/1998 Brauner et al.
5,800,724 A 9/1998 Habeger et al.
5,934,472 A 8/1999 Ramirez et al.
5,938,112 A 8/1999 Sandstrom
6,093,460 A * 7/2000 Iwaya ..... B31F 1/0087 156/224
6,114,679 A 9/2000 Lai et al.
6,150,646 A 11/2000 Lai et al.
6,204,492 B1 3/2001 Zeng et al.
6,213,301 B1 4/2001 Landis et al.
6,251,451 B1 6/2001 Zeng
6,325,213 B1 12/2001 Landis
D456,673 S * 5/2002 Kerman ..... D7/543
6,414,290 B1 7/2002 Cole et al.
6,415,945 B1 7/2002 Zank et al.
6,433,322 B2 8/2002 Zeng et al.
6,455,827 B2 9/2002 Zeng
6,527,687 B1 * 3/2003 Fortney ..... B26F 1/40 493/56
6,552,315 B2 4/2003 Zeng et al.
6,568,534 B2 5/2003 Zank
6,677,563 B2 1/2004 Lai
6,717,121 B2 4/2004 Zeng et al.
6,765,182 B2 7/2004 Cole et al.
6,988,654 B2 1/2006 Wnek
7,337,943 B2 3/2008 Johns et al.
7,552,840 B2 * 6/2009 Gitschlag ..... A47G 19/065 220/556
8,197,740 B2 * 6/2012 Spengler ..... B29C 43/36 264/291
8,464,871 B2 6/2013 Wnek
8,584,929 B2 * 11/2013 Littlejohn ..... B65D 1/34 220/574
8,801,995 B2 * 8/2014 Wnek ..... B65D 1/34 264/252
9,371,150 B2 * 6/2016 Wnek ..... B65D 1/28
2002/0092791 A1 * 7/2002 Wnek ..... B65D 21/0233 206/519
2002/0113118 A1 * 8/2002 Littlejohn ..... A47G 19/03 229/407
2003/0205319 A1 11/2003 Bengtsson et al.
2004/0262322 A1 12/2004 Middleton et al.
2005/0109653 A1 5/2005 Wnek et al.
2006/0198972 A1 * 9/2006 Ueda ..... B65D 1/34 428/35.2
2007/0081743 A1 4/2007 Kim
2007/0267374 A1 11/2007 Middleton et al.
2009/0173776 A1 * 7/2009 Swoboda ..... A47G 19/03 229/407
2009/0223952 A1 * 9/2009 Wnek ..... B65D 1/34 219/730
2009/0250372 A1 * 10/2009 Wnek ..... B29C 45/0046 206/557
2012/0118880 A1 * 5/2012 Wnek ..... B31B 1/00 219/725

FOREIGN PATENT DOCUMENTS

DE 87 13 290.7 1/1988
DE 37 37 052 A1 5/1989
DE 296 02 348 U1 5/1996
DE 101 49 143 A1 4/2003
EP 0 082 209 6/1983
EP 1 332 972 8/2003
FR 2 266 638 10/1975
FR 2 599 002 11/1987
FR 2 733 715 11/1996
GB 1 264 484 2/1972
GB 1 348 370 3/1974
GB 1 376 603 12/1974
GB 2 171 048 8/1986
JP 47-23456 10/1972
JP 54-116059 9/1979
JP 54-126887 10/1979
JP 56065866 U 6/1981
JP 59-75004 4/1984
JP 03-004582 1/1991
JP 3057020 U 5/1991

(56) References Cited

FOREIGN PATENT DOCUMENTS

| | | |
|---|---|---|
| JP | 6000843 | 1/1994 |
| JP | 60-96234 | 4/1994 |
| JP | 07-28883 | 1/1995 |
| JP | 08-156944 | 6/1996 |
| JP | 3031361 | 9/1996 |
| JP | 8-337234 | 12/1996 |
| JP | 08-337235 | 12/1996 |
| JP | 09-254948 | 9/1997 |
| JP | 2000-043840 | 2/2000 |
| JP | 2000-142825 | 5/2000 |
| JP | 2000-238760 | 9/2000 |
| JP | 2000-335550 | 12/2000 |
| JP | 2000-517260 | 12/2000 |
| JP | 2001-213420 | 8/2001 |
| JP | 2001-328617 | 11/2001 |
| WO | WO 96-11142 | 4/1996 |
| WO | WO 98-09812 | 3/1998 |
| WO | WO 03/066435 | 8/2003 |
| WO | WO 03/078012 | 9/2003 |
| WO | WO 04-033324 | 4/2004 |
| WO | WO 08-049048 | 4/2008 |
| WO | WO 09-086501 | 7/2009 |
| WO | WO 09-088904 | 7/2009 |

OTHER PUBLICATIONS

International Search Report & Written Opinion PCT/US2007/081743 dated May 28, 2008.
International Search Report and Written Opinion for PCT/US2010/048741 dated May 18, 2011.
Office Action for U.S. Appl. No. 12/881,632 dated Apr. 28, 2011.
Response to Restriction Requirement for U.S. Appl. No. 12/881,632 dated May 12, 2011.
Preliminary Amendment for U.S. Appl. No. 12/881,632 dated Jun. 24, 2011.
Office Action for U.S. Appl. No. 12/881,632 dated Jul. 1, 2011.
Amendment A and Response to Office Action for U.S. Appl. No. 12/881,632 dated Sep. 29, 2011.
Notice of Allowance and Fee(s) Due for U.S. Appl. No. 12/881,632 dated Feb. 28, 2013.
Part B—Fee(s) Transmittal for U.S. Appl. No. 12/881,632 dated May 15, 2013.
Issue Notification for U.S. Appl. No. 12/881,632 dated May 29, 2013.

* cited by examiner

BLANK AND FORMING TOOL FOR FORMING A CONTAINER

CROSS-REFERENCE TO RELATED APPLICATIONS

This application is a divisional of U.S. patent application Ser. No. 12/881,632, filed Sep. 14, 2010, which application claims the benefit of U.S. Provisional Patent Application No. 61/242,145, filed Sep. 14, 2009.

INCORPORATION BY REFERENCE

U.S. patent application Ser. No. 12/881,632, filed Sep. 14, 2010, and U.S. Provisional Patent Application No. 61/242,145, which was filed on Sep. 14, 2009, are hereby incorporated by reference for all purposes as if presented herein in their entirety.

BACKGROUND OF THE DISCLOSURE

The present disclosure relates to blanks, containers, trays, constructs, forming tools and various features to facilitate forming a container from a blank.

SUMMARY OF THE DISCLOSURE

In one aspect, the disclosure is generally directed to a blank for being formed into a container. The blank has a marginal area that includes a plurality of score lines for facilitating forming of the blank into the container. The score lines are positioned to facilitate formation of the container.

In another aspect, the disclosure is generally directed to a container formed from a blank. The container includes features that are formed by a plurality of score lines in a marginal portion of the blank.

In another aspect, the disclosure is generally directed to a forming tool for forming a container from a blank. The forming tool comprises a forming cavity for receiving the blank and a punch for being at least partially received in the cavity to form the blank into the container. The cavity has features to facilitate forming the container from the blank.

In another aspect, the disclosure is generally directed to a blank for forming a container. The blank comprises a central portion, an outer edge, and a marginal portion between the outer edge and the central portion. The blank comprises a radius extending from a center of the blank to the outer edge. The marginal portion comprises a plurality of radial score lines having an angular spacing between respective adjacent radial score lines. The plurality of score lines comprises at least one first score line and at least one second score line. The at least one first score line has a first length and the least one second score line has a second length. The first length being less than the second length.

In another aspect, the disclosure is generally directed to a tool for forming a container from a blank. The tool comprises a first tool assembly and a second tool assembly. At least one of the first tool assembly and the second tool assembly is moveable between an open position wherein the blank is received between the first and the second tool assembly and a closed position wherein the blank is formed into the container. At least one of the first and the second tool assembly has a curved surface for forming a transition between a flange of the container formed from the blank and a side wall of the container formed from the blank.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure relates generally to various aspects of containers, constructs, trays, materials, packages, elements, and articles, and methods of making such containers, constructs, trays, materials, packages, elements, and articles. Although several different aspects, implementations, and embodiments are disclosed, numerous interrelationships between, combinations thereof, and modifications of the various aspects, implementations, and embodiments are contemplated hereby. In one illustrated embodiment, the present disclosure relates to forming a container or tray for holding food items or various other articles. However, in other embodiments, the container or tray can be used to form other non-food containing articles or may be used for heating or cooking.

Figure 8:
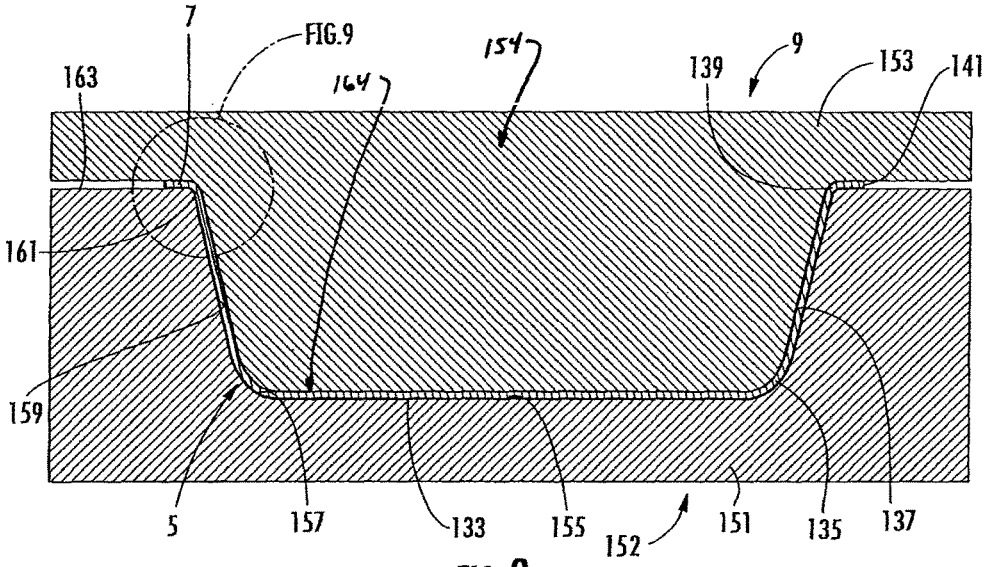
FIG. 8 is a cross section of a tool for forming a container from a blank according to an embodiment of this disclosure.
Figure 9:
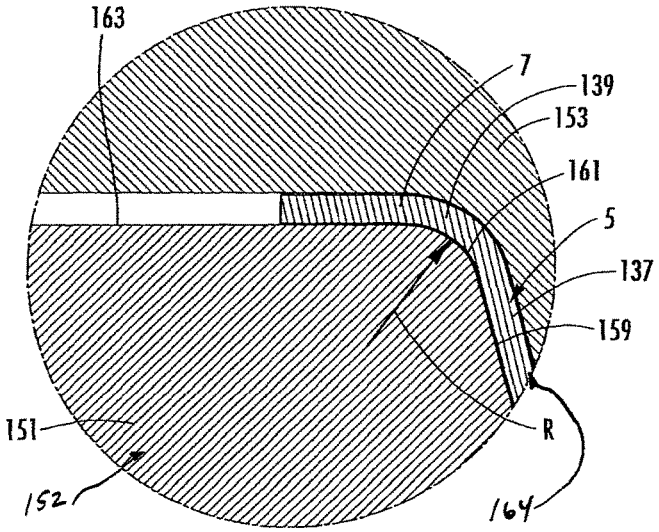
FIG. 9 is an enlarged portion of FIG. 8.

FIGS. 1-4 are a plan views of a blank 3 of various embodiments (indicated 3A-3D) that are used to form a container 5 (FIGS. 5-7) having a flange 7. In the illustrated embodiment, each of the blanks 3 is generally circular and is for being press formed into the container 5 that, in the illustrated embodiment, is a generally circular tray. It is understood that each blank 3 can be press-formed into the container 5 by a forming tool 9 (FIGS. 8 and 9). The forming tool 9 can be similar to and have similar features and/or components conventional forming tools such as are disclosed in U.S. Patent Application Publication No. 2005/0109653, the entire contents of which are incorporated herein by reference for all purposes. Also, the forming tool 9 can have similar features and components such as the forming tool disclosed in International Publication No. WO 2008/049048 ("the '048 publication"), the entire contents of which are incorporated by reference for all purposes, or any other suitable forming tool assembly. Also, the blanks 3 and the container 5 could be shapes other than circular (e.g., oval, rectangular, irregular, etc) without departing from the scope of this disclosure. The blanks 3 of the present disclosure have features that allow the container 5 made from each blank to have a flange 7 that is a substantially uniform width around the perimeter of the container.

The blanks 3 or container 5 can have denesting features such as any suitable denesting feature described in the '048 publication or in U.S. application Ser. No. 12/868,850, filed Aug. 26, 2010, the entire contents of which are incorporated by reference herein for all purposes.

Figure 1:
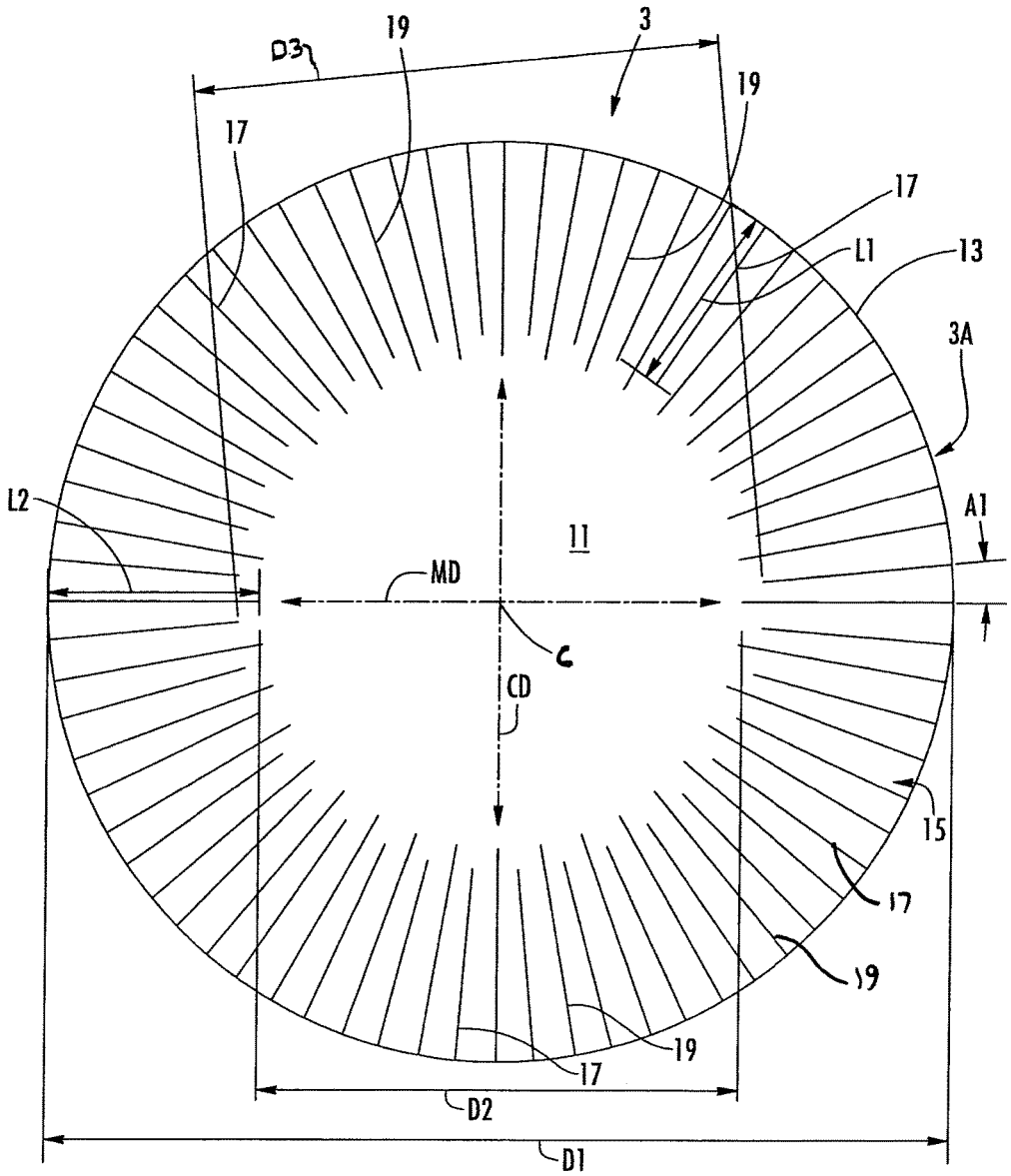
FIG. 1 is a plan view of a blank for being formed into a container according to a first embodiment of this disclosure.

As shown in FIG. 1, the blanks have a machine-direction (MD) or feed direction corresponding to the direction the blanks are conveyed as they are positioned in the tool, and a cross-direction (CD), that is generally perpendicular to the machine-direction. The blank 3A has a central portion 11, an outer edge 13, and a marginal portion 15 between the outer edge and the central portion. The blank 3 includes a lateral axis L1 and a longitudinal axis L2 that is generally perpendicular to the lateral axis.

In the first embodiment, the marginal portion 15 of the blank 3 includes a plurality of score lines 17, 19. The score lines 17, 19 are all positioned in the marginal portion 15 such that the score lines extend generally radially from the center C of the blank (e.g., the score lines would not intersect each other and would intersect the center of the blank if the score lines were extended past the marginal portion). The score lines 17 are shorter than the score lines 19. In one embodiment, adjacent score lines 17, 19 are spaced apart by an angle of at least approximately 5 degrees that is uniform around the perimeter of the blank. The central portion 11 can be substantially free of any fold lines, score line, or other line of weakening, without departing from the disclosure. Further, the central portion 11 can have a line of weakening to facilitate forming the blank 3 into the container 5 without departing from the disclosure.

All dimensional information presented herein is intended to be illustrative of certain aspects, features, etc., of various embodiments of the disclosure, and is not intended to limit the scope of the disclosure. The dimensions of the blanks, containers, forming tools, features, or any other dimension, can be more or less than what is shown and described in this disclosure without departing from the scope of this disclosure.

As shown in the first embodiment, the blank 3A has a diameter D1 of at least approximately 6.687 inches, the central portion 11 has a minimum diameter D2 between respective ends of the score lines 19 of at least approximately 3.590 and a maximum diameter D3 between respective ends of the score lines 17 of at least approximately 3.932 inches. In the embodiment of FIG. 1, the shorter score lines 17 have a length L1 of at least approximately 1.3775 inches and the longer score lines 19 have a length L2 of at least approximately 1.5485 inches, making the minimum radial length of the marginal portion 15 the length L1, and the maximum radial length of the marginal portion the length L2. In the embodiment of FIG. 1, the blank 3 has 72 score lines 17, 19, each respectively spaced apart by an angle A1 of approximately five degrees, but more or less than 72 score lines could be provided and the angle A1 could be more or less than five degrees.

In one embodiment, the score lines 19 are at least about 5 percent longer than the score lines 17, in another embodiment, the score lines 19 can be at least about 10 percent longer than the score lines 17, and in yet another embodiment, the score lines 19 can be at least about 12 percent longer than the score lines 17.

Figure 2:
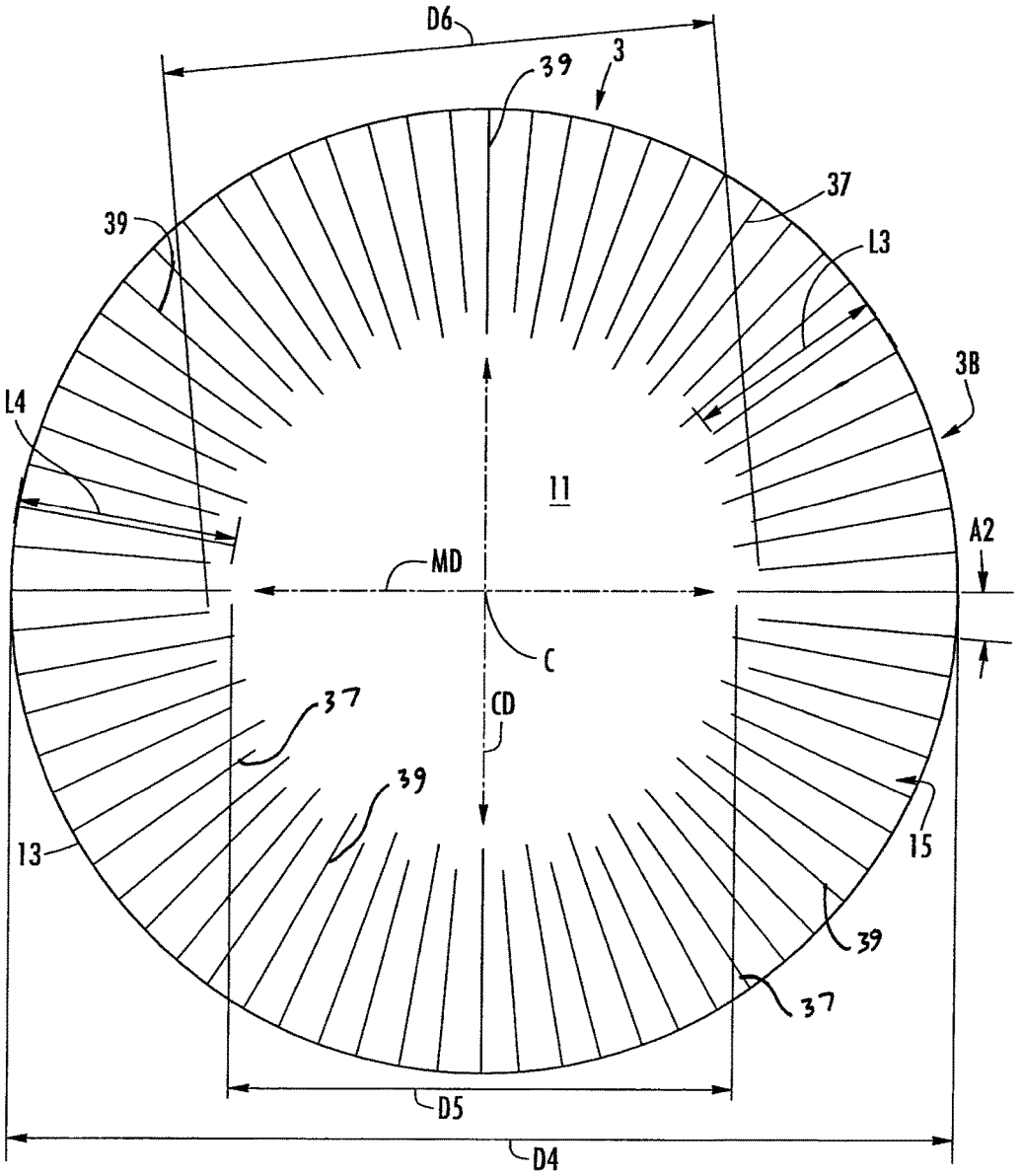
FIG. 2 is a plan view of a blank for being formed into a container according to a second embodiment of this disclosure.

In the embodiment of FIG. 2, the blank 3B has a larger diameter D4 than the diameter D1 of blank 3A, the central portion 11 has a minimum diameter D5 that is the same as the minimum diameter D2 of the blank 3A, and the central portion has a maximum diameter D6 that is the same as the maximum diameter D3 of the blank 3A. The score lines 37, 39 of the blank 3B are longer than the score lines 17, 19 of the blank 3A. In the embodiment of FIG. 2, the blank 3B has a diameter D4 of at least approximately 6.937 inches, the score lines 37 have a length L3 of at least approximately 1.5025 inches, and the score lines 39 have a length L4 of at least approximately 1.6735 inches. The blank 3B includes 72 score lines 37, 39 at an equal 5 degree angular spacing A2 between adjacent score lines.

Figure 3:
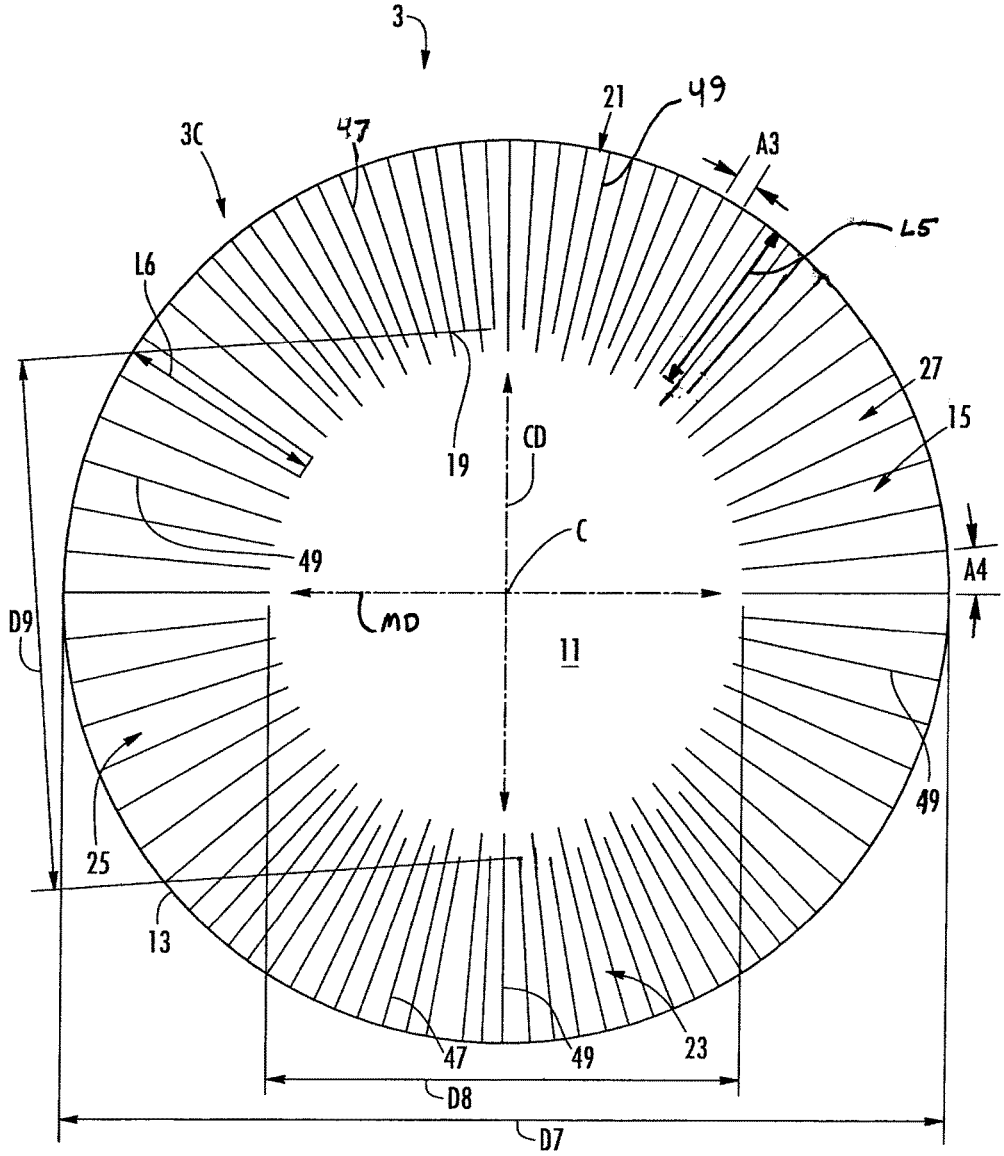
FIG. 3 is a plan view of a blank for being formed into a container according to a third embodiment of this disclosure.

In the embodiment of FIG. 3, the blank 3C has a diameter D7 that is equal to the diameter D1 of the blank 3A, the central portion 11 has a minimum diameter D8 that is the same as the minimum diameter D2 of the blank 3A, and the central portion has a maximum diameter D9 that is the same as the maximum diameter D3 of the blank 3A. The marginal portion 15 of the blank 3C includes score lines 47, 49. The score lines 47, 49 have a respective length L5, L6 that is equal to the corresponding length L1, L2 of a respective score line 17, 19 of the blank 3A of the first embodiment. In the third embodiment, the blank 3C includes a greater number and different arrangement of the score lines 47, 49. The blank 3C has cross-direction portions 21, 23 of the marginal portion 15 at respective opposite sides of the blanks. The cross-direction portions 21, 23 each includes score lines 47, 49 that are more closely spaced than the previous embodiments. In the embodiment of FIG. 3, each cross-direction portion 21, 23 includes 29 score lines 47, 49 that are spaced apart at an equal 3.21 degree spacing A3 between adjacent score lines.

In the embodiment of FIG. 3, the blank 3C has machine-direction portions 25, 27 of the marginal portion 15 that includes the longer score lines 49 that are spaced apart a greater distance than the spacing of the previous embodiments. In one embodiment, the machine-direction portions 25, 29 are free from the shorter score lines 47. In the illustrated embodiment, the score lines 49 in the machine-direction portions 25, 27 of the blank 3C are spaced apart at an equal 5.71 degree spacing A4 between adjacent score lines. Each of the machine-direction portions 25, 27 includes 15 score lines 49 so that the blank 3C includes a total of 88 score lines (15 in each machine direction portion 25, 27 and 29 in each cross-direction portion 21, 23).

Figure 4:
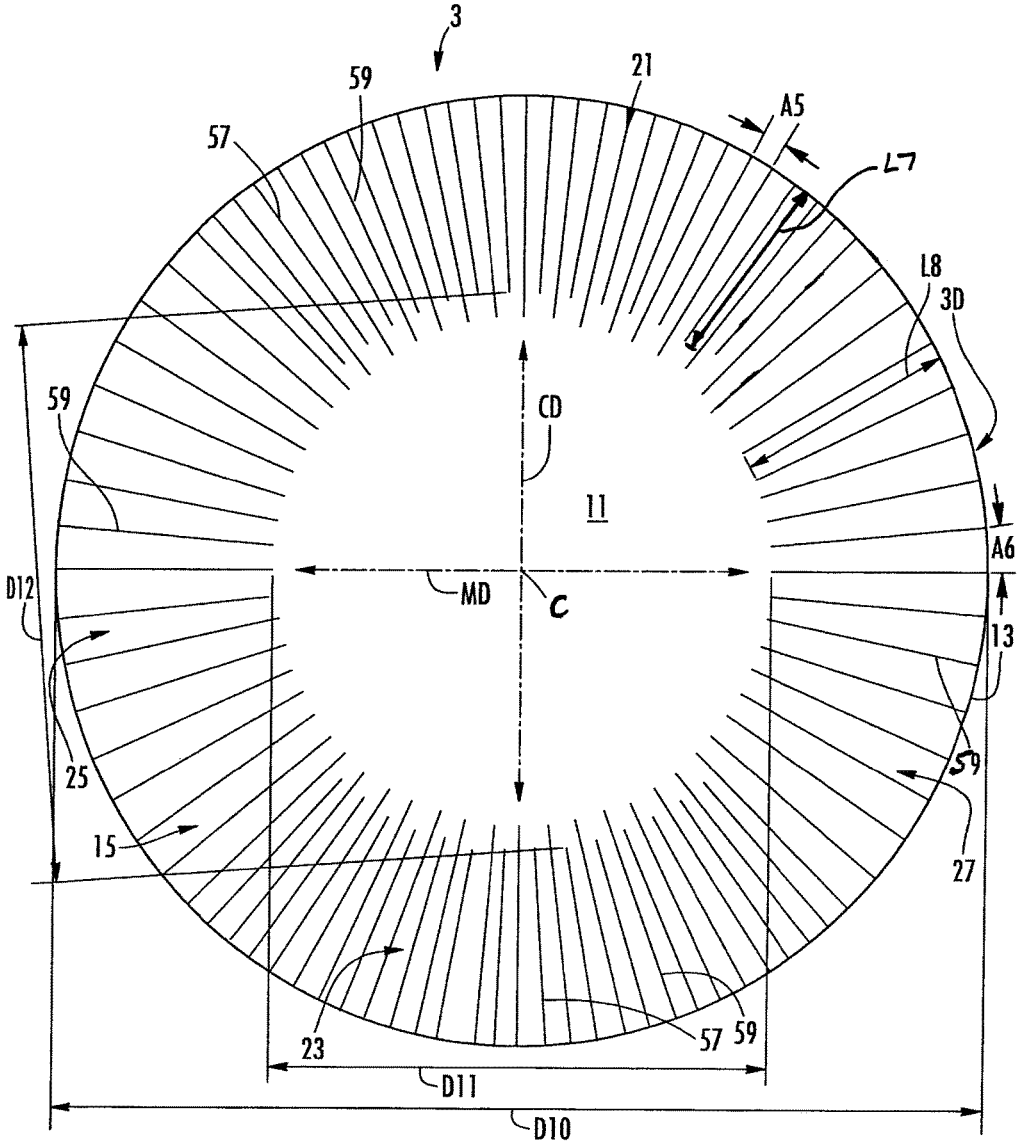
FIG. 4 is a plan view of a blank for being formed into a container according to a fourth embodiment of this disclosure.

In the embodiment of FIG. 4, the blank 3D has a diameter D10 that is equal to the diameter D2 of the blank 3B of the second embodiment, and the score lines 57, 59 have respective lengths L7, L8 that are the same length as the length L3, L4 of the score lines 37, 39 of the blank 3B of the second embodiment. The central portion 11 has a minimum diameter D10 that is the same as minimum diameter D2 of the blank 3A, and the central portion has a maximum diameter D11 that is the same as the maximum diameter D3 of the blank 3A. The blank 3D has cross-direction portions 81, 83 and machine-direction portions 85, 87 that are similar to the portions 23, 23 and 25, 27 of the blank 3C of the third embodiment in that the cross-direction portions 81, 83 each include 29 score lines 57, 59, with an equal 3.21 degree spacing A5 between respective adjacent score lines. The machine-direction portions 85, 87 each include 15 score lines 79, with an equal 5.71 degree spacing A6 between respective adjacent score lines.

The score lines 17, 19, 37, 39, 47, 49, 57, 59 of the blanks 3A, 3B, 3C, 3D can be otherwise shaped, arranged, and/or configured without departing from the scope of this disclosure. In one embodiment, the blank 3 comprises 18 point paperboard having a thickness of approximately 0.018" (0.46 mm), but the blank 3 could have a larger or smaller thickness or could comprise other materials. All of the dimensional information presented herein is intended to be illustrative of certain aspects of the disclosure and is not intended to limit the scope of the disclosure, as various other embodiments of the disclosure could include dimensions that are greater than or less than the dimensions included herein.

Figure 5:
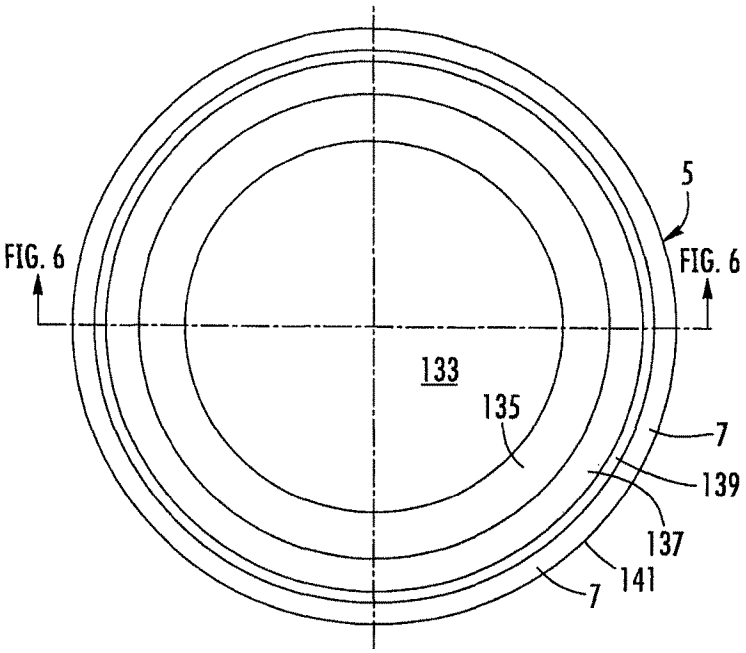
FIG. 5 is a top view of a container formed from a blank according to an embodiment of this disclosure.
Figure 6:
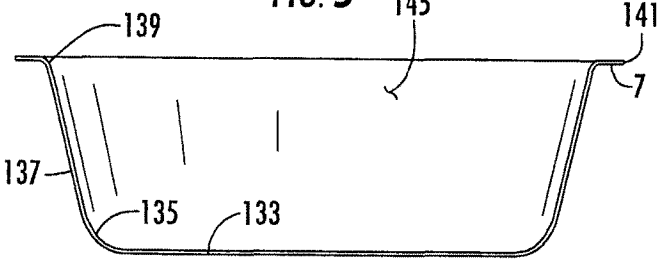
FIG. 6 is a side view of a container formed from a blank according to an embodiment of this disclosure.
Figure 7:
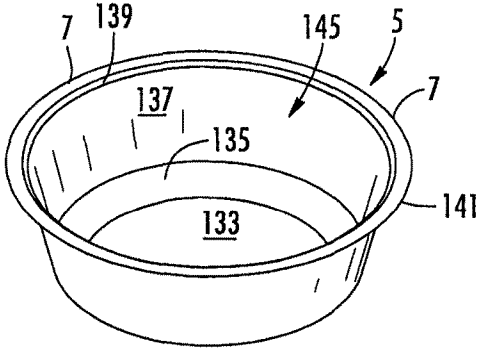
FIG. 7 is a perspective view of a container formed from a blank according to an embodiment of this disclosure.

FIGS. 5-7 show various views of the container 5 formed from a respective one of the blanks 3. The container 5 comprises a generally flat bottom wall 133, a bottom corner 135 that connects the bottom wall to an annular side wall 137, an upper corner 139 that connects the side wall 137 to the flange 7, and an outer radial edge 141. The bottom wall 133 and side wall 137 at least partially define an interior space 145 of the container 5. The container 5 could be otherwise shaped, arrange, configured, and/or dimensioned without departing from this disclosure.

As shown in FIGS. 8 and 9, the forming tool 9 comprises a cavity block 151 that is part of a lower tool assembly 152, and a punch or nose 153 that is part of an upper tool assembly 154. The cavity block 151 has a bottom wall 155, a lower corner 157 that connects the bottom wall to an annular side wall 159, an upper corner 161 that connects the sidewall to an upper surface 163. The bottom wall 155, lower corner 157, annular side wall 159, upper corner 161 form a recess 164 in the cavity block 151 below the upper surface 163. The upper surface 163 supports the flange 7 when the punch 153 has been received into the recess 164 of the cavity block 151 to form the blank 3 into the container 5. The recess 164 and upper surface 163 of the cavity block 151 are generally shaped to correspond with the desired shape of the container 5.

The upper corner 161 is a rounded surface between the flat upper surface 163 and the flat side wall surface 159 that has an increased radius to minimize forces that occur when the blank 3 is pulled over the upper corner of the forming tool 9 during formation of the container 5 from the blank. The upper corner 161 forms the upper corner 139 of the container 5 that connects the flange 7 to the side wall 137. In one embodiment the upper corner 61 has a radius R of at least approximately 0.05 inches, and preferably at least about 0.062 inches.

In one embodiment, the blank 3 is formed into the container by conveying a blank in the machine direction MD and placing the blank in the forming tool 9 when the lower tool assembly 152 and upper tool assembly are in a separated or open position. The forming tool 9 is used to press form the blank 3 into the container 5 by moving the tool assemblies 152, 154 together, to a closed position (FIGS. 8 and 9), in a manner such that the punch 153 is pressed against the blank 3 to force the blank into the cavity 164 of the cavity block 151. When the flat blank 3 is pressed into the cavity 154 and formed into the three-dimensional container 5 by closing the forming tool 9, the score lines 17, 19, 37, 39, 47, 49, and 57, 59 facilitate forming the flat blank into the three-dimensional container in the forming tool 9. The score lines 17, 19, 37, 39, 47, 49, 57, and 59 allow formation of the marginal portion 15 of the blank 3 into the side wall 137 and flange 7 of the container 5. The flange 7 is formed by being pressed between the nose 153 and the flat upper surface 163 of the cavity block 151. The stiffness of the paperboard material of the blanks 3A, 3B is approximately twice as great in the cross-direction areas as the machine-direction areas. Since the paperboard stiffness is generally weaker in the machine-direction, the blanks 3A, 3B can be subjected to twice the elongation in the machine-direction areas as compared to the cross-direction areas when the blanks 3 are press-formed into the container 5.

In one embodiment of the disclosure, the blank 3C has weakening features that can comprise an increased number of score lines 47, 49 in the cross-direction portions 21, 23 of the marginal area 15 of blank 3C and a decreased spacing A3 between the score lines 47, 49 in the cross-direction areas 21, 23. Also, in one embodiment of the disclosure, the blank 3C has strengthening features that can comprise an increased spacing A4 between the score lines 49 in the machine-direction portions 25, 27. In the illustrated embodiment, each cross-direction area 21, 23 has fourteen first score lines 47 and fifteen second score lines 49, and each machine direction area 25, 27 has fifteen second score lines 49 and zero first score lines 47. Similarly, the blank 3D has weakening features that can comprise an increased number of score lines 57, 59 in the cross-direction portions 81, 83 of the marginal area 15 of the blank 3D and a decreased spacing A5 between the score lines 57, 59 in the cross-direction areas. Further, the blank 3D has strengthening features that can comprise an increased spacing A6 between the score lines 59 in the machine-direction portions 85, 87. The arrangement and positioning of the score lines 47, 49 and 57, 59 in a respective blank 3C, 3D, promotes a uniform width of the flange 7 when the blanks 3C, 3D are formed into the container 5. The stiffness of the blanks 3C, 3D in the cross-direction portions 21, 23, and 81, 83 is reduced by the weakening features that can comprise increased number and closer spacing of the score lines 47, 49, and 57, 59 so that the cross-direction portions will have increased elongation when the blanks are formed into the container 5. The stiffness of the blanks 3C, 3D in the machine-direction portions 25, 27, and 85, 87 is increased as compared to the cross-direction portions 21, 23, and 81, 83, because the strengthening features in the machine direction portions 25, 27, and 85, 87 have a decreased number and larger spacing of the first score lines 49, 59, so that the machine-direction portions will have decreased elongation as compared to the cross-direction portions when the blanks are formed into the container 5.

Also, the radius R of the upper corner 161 of the cavity 151 of the forming tool 9 is increased to minimize the creation of bending forces that will occur when the blanks 3 are formed into the container 5. The forming tool 9 can have other features to facilitate forming of the container 5 from any of the blanks 3A, 3B, 3C, 3D without departing from the scope of this disclosure.

In one aspect, for example, any of the blanks 3A, 3B, 3C, 3D can comprise paperboard having a basis weight of from about 60 to about 330 lbs/ream, (about 27 to about 148 Kg/ream wherein a ream equals 3,000 $ft^2$ or 279 $m^2$), for example, from about 80 to about 140 lbs/ream (about 36 Kg/ream to about 63 Kg/ream). The paperboard generally may have a thickness of from about 6 to about 30 mils, for example, from about 12 to about 28 mils. In one particular example, the paperboard has a thickness of at least about 12 mils. Any suitable paperboard may be used, for example, a solid bleached or solid unbleached sulfate board, such as SUS® board, commercially available from Graphic Packaging International. In another aspect, where a more flexible construct is to be formed, the blank may comprise a paper or paper-based material generally having a basis weight of from about 15 to about 60 lbs/ream (about 6.75 Kg/ream to about 27 Kg/ream), for example, from about 20 to about 40 lbs/ream (about 9 Kg/ream to about 18 Kg/ream). In one particular example, the paper has a basis weight of about 25 lbs/ream (about 11 Kg/ream).

Optionally, one or more portions of the blank or other constructs described herein or contemplated hereby may be coated with varnish, clay, or other materials, either alone or in combination. The coating may then be printed over with product advertising or other information or images. The blanks or other constructs also may be selectively coated and/or printed so that less than the entire surface area of the blank or substantially the entire surface area of the blank may be coated and/or printed.

The foregoing description illustrates and describes various embodiments of the present disclosure. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, and alterations, etc., of the above-described embodiments. Additionally, the disclosure shows and describes only selected embodiments, but various other combinations, modifications, and environments are contemplated and are within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments without departing from the scope of the disclosure.

What is claimed is:

1. A method of forming a container from a blank, the method comprising:

obtaining a tool, the tool comprising a first tool assembly having a nose having an external surface shaped to correspond to at least a portion of the container, a second tool assembly having a cavity block having a recess shaped to correspond with at least a portion of the container and formed by an external surface of the cavity block that generally corresponds to the shape of the container, the external surface of the cavity block comprises a bottom surface, a side surface extending upwardly from the bottom surface, a flat upper surface that is parallel to the bottom surface, and a curved surface that extends between the side surface and the flat upper surface;

obtaining a circular blank comprising a plurality of radial score lines, at least one cross-direction portion along a cross-direction of the blank, and at least one machine-direction portion along a machine-direction of the blank, a different number of radial score lines of the plurality of radial score lines are arranged on the at least one cross-direction portion of the blank than a number of radial score lines arranged on the at least one machine-direction portion of the blank;

operating at least one of the first tool assembly and the second tool assembly is moved to an open position wherein the first tool assembly and the second tool assembly are spaced apart;

positioning the blank between the first tool assembly and the second tool assembly;

forming the blank into the container by operating at least one of the first tool assembly and the second tool assembly is moved to a closed position wherein the blank is pressed between the first tool assembly and the second tool assembly and the nose is at least partially received in the cavity block, the forming the blank into the container comprises forming a bottom wall of the container by pressing the blank against the bottom surface, forming a side wall of the container by pressing the blank against the side surface, forming a flange of the container by pressing the blank against the flat upper surface, the flange being parallel to the bottom wall, and forming a transition between the flange of the container formed from the blank and the side wall of the container formed from the blank by pressing the blank against the curved surface, the transition between the flange and the side wall being curved to correspond to the shape of the curved surface.

2. The method of claim 1 wherein the curved surface has a radius of at least about 0.05 inches.

3. The method of claim 1 wherein the blank comprises a central portion, an outer edge, and a marginal portion between the outer edge and the central portion.

4. The method of claim 3 wherein the blank comprises a radius extending from a center of the blank to the outer edge, the marginal portion of the blank comprises the plurality of radial score lines having an angular spacing between respective adjacent radial score lines, the plurality of radial score lines comprising a plurality of first radial score lines and a plurality of second radial score lines, the first radial score lines each having a respective first length and the second radial score lines each having a respective second length, the first length being less than the second length, the machine direction corresponds to the feed direction of the blank into the forming tool and the cross-direction is perpendicular to the machine direction, the marginal portion comprises the at least one cross-direction portion and the at least one machine direction portion and comprises a first cross-direction portion at one cross-directional end of the blank, a second cross-direction portion at a second cross-directional end of the blank, a first machine-direction portion at one machine directional end of the blank, and a second machine-direction portion at a second machine-directional end of the blank, the blank comprises weakening features in each of the first cross-direction portion and the second cross-direction portion for weakening the blank to promote stretching of the blank in the first cross-direction portion and the second cross-direction portion, and strengthening features in each of the first machine-direction portion and the second machine-direction portion for strengthening the blank to resist stretching of the blank in the first machine-direction portion and the second machine-direction portion, the weakening features comprise the plurality of first radial score lines and at least a portion of the plurality of second radial score lines, the strengthening features comprise at least a portion of the plurality of second radial score lines, and the strengthening features are free from any of the first radial score lines in the first machine-direction portion and the second machine-direction portion.

5. The method of claim 4 wherein in each of the weakening features each of the plurality of first radial score lines are adjacent to and spaced apart from a respective one of the second radial score lines by a first angular spacing.

6. The method of claim 5 wherein each of the second radial score lines being adjacent to another of the second radial score lines and being spaced apart from a respective one of the second radial score line by a second angular spacing, the second angular spacing being greater than the first angular spacing.

7. The method of claim 4 wherein the first cross-direction portion having the same quantity of first and second radial score lines as the second cross-direction portion.

8. The method of claim 7 wherein the first machine-direction portion has the same quantity of second radial score lines as the second machine-direction portion.

9. The method of claim 4 wherein the combined quantity of first and second radial score lines in each of the first and second cross-direction portion is greater than the quantity of second radial score lines in each machine-direction portion.

10. The method of claim 4 wherein each of the first radial score line and the second radial score line extend from the outer edge of the blank to a location adjacent the central portion of the blank.

11. The method of claim 3 wherein the forming the blank into the container comprises forming the bottom wall from the central portion, forming the side wall extending upwardly from the bottom wall from at least a portion of the marginal portion of the blank, and forming the flange extending laterally outward from the side wall from at least a portion of the marginal portion of the blank.

12. The method of claim 11 wherein the bottom wall is generally circular and the container is a tray with the top surface of the flange corresponding to a top surface of the tray.

13. The method of claim 11 wherein the transition comprises an upper corner that connects the side wall to the flange, the upper corner being a curved portion of the container.

14. The method of claim 13 wherein the upper corner comprises the transition formed at the curved surface of the tool.

15. The method of claim 1 wherein the external surface of the nose has a flat surface parallel to the flat upper surface, the forming the flange of the container comprises contacting the blank with the flat surface of the nose and pressing the blank against the flat upper surface of the cavity block.

16. The method of claim 1, wherein, the number of radial score lines of the plurality of radial score lines arranged on the at least one cross-direction portion of the blank is greater than the number of radial score lines arranged on the at least one machine-direction portion of the blank.

* * * * *